US005831491A

United States Patent [19]

Buer et al.

[11] Patent Number: 5,831,491

[45] Date of Patent: Nov. 3, 1998

[54] HIGH POWER BROADBAND TERMINATION FOR K-BAND AMPLIFIER COMBINERS

[75] Inventors: Kenneth Vern Buer, Gilbert; John Holmes, Scottsdale; David Warren Corman, Gilbert, all of Ariz.

[73] Assignee: Motorola, Inc., Schaumburg, Ill.

[21] Appl. No.: 702,782

[22] Filed: Aug. 23, 1996

[51] Int. Cl.[6] ..... H01P 5/12; H01P 1/22; H01P 1/26

[52] U.S. Cl. ..... 333/128; 330/295; 333/22 R; 333/81 A

[58] Field of Search ..... 333/128, 81 A, 333/22 R; 330/286, 295

[56] References Cited

U.S. PATENT DOCUMENTS

| | | | |
|---|---|---|---|
| 4,024,478 | 5/1977 | Wolfe | 333/22 R X |
| 4,647,877 | 3/1987 | Thompson | 333/22 R |
| 5,151,676 | 9/1992 | Sato | 333/22 R X |
| 5,313,174 | 5/1994 | Edwards | 333/116 X |

OTHER PUBLICATIONS

Wideband Microstrip Termination, Walter Fischer and Werner Wiesbeck, Heft 2, NTZ 1973, 83–85.

Design of High Resistance Non–Grounded Braodband Loads in Terminations and Attenuators, L.J. Peter Linner, Chalmers University of Technology, Div. Network Theory S–412 96, pp. 465–466.

*Primary Examiner*—Paul Gensler

*Attorney, Agent, or Firm*—Gregory J. Gorrie

[57] ABSTRACT

An extremely broad band high power termination (10) for microwave and millimeter frequency amplifiers combines a standard resistive low frequency termination (15) with a broad band high frequency absorptive element (13) using an absorptive material such as Eccosorb. A mid-band matching network (14) is provided between the resistive termination (15) and the Eccosorb absorptive element (13). The Eccosorb absorbs the energy of the higher microwave frequencies while the resistor absorbs energy at low frequencies. Accordingly, a much higher power handling capability in a compact planer environment is achieved. This termination (10) is suitable use for use in K-band power amplifier combiners (30) that require high isolation and high power handling capability of the isolated ports (35).

27 Claims, 2 Drawing Sheets

HIGH POWER BROADBAND TERMINATION FOR K-BAND AMPLIFIER COMBINERS

FIELD OF THE INVENTION

This invention relates in general to the field of microwave circuits in particular it relates to attenuators and more particularly it relates to high power broad band terminations for K-band power amplifiers.

BACKGROUND OF THE INVENTION

In many microwave circuits it is desirable to have a matched characteristic impedance load used as a termination. For example, these matched loads are useful in branch line and Lange configuration hybrid power combiners and dividers as well as in mixers, doublers and couplers. In most cases it is desirable to have a broad bandwidth termination so that the termination is not a limiting factor in the bandwidth of the circuit. Broad bandwidth terminations are also desirable to terminate and absorb any out-of-band harmonics, inter-modulation spurs or mixer products and prevent reflective and loop oscillation modes in power combining circuits. Standard resistor terminations for microwave circuits are generally very narrow band and may result in loop oscillation problems.

In power combining applications, it is desirable for a termination to have the ability to handle very high power levels. This helps prevent damage to amplifiers in the event a short or open circuit load is presented at the output of the amplifier, when the VSWR is poor or when out-of-band signals are reflected back into the power amplifier from output filters. In high frequency design, terminations are desirably small in size because of shorter wavelengths. The small size usually results in very low power handling capability for such terminations. A typical termination for example, can tolerate only an ⅛ watt of reflected power due to the small size lumped element resistors that are typically used. When power amplifiers are capable of producing up to 4 Watts of output RF power, the amplifier should be terminated with greater than 15 dB loss to prevent any damage. When these amplifiers feed antennas, waveguide isolators are typically used to isolate the poor return loss of the antenna from the amplifier's output. However, in satellite applications, the waveguide isolator's large size and weight make them undesirable.

Typical high power and broad-band microwave terminations are generally hard to manufacture resulting in high cost. This is because in order to achieve broad bandwidths in these typical terminations, expensive and time consuming tuning is required. This is generally not acceptable in commercial satellite and mobile communication systems where higher volume and lower cost microwave millimeter hardware are required.

Thus, what is needed is an improved broad-band termination. What is also needed is a termination suitable for use in a satellite communication system. What is also needed is a broad-band, high power, low cost, easily manufacturable, microwave and millimeter termination suitable for use in a satellite communication system.

What is also needed is a K-band amplifier combiner that eliminates the need for isolators and provides good return loss at the antenna port.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

Figure 1:
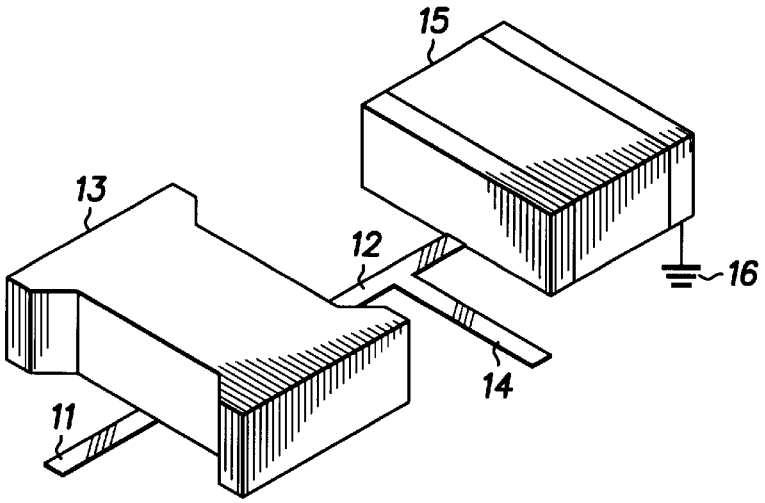
FIG. 1 illustrates a broad-band high power termination in accordance with a preferred embodiment of the present invention.

The exemplification set out herein illustrates a preferred embodiment of the invention in one form thereof, and such exemplification is not intended to be construed as limiting in any manner.

DETAILED DESCRIPTION OF THE DRAWINGS

The present invention provides, among other things, an improved broad band termination. The present invention also provides, a broad band, high power termination suitable for use in satellite communication systems. The present invention also provides a low cost, easily manufacturable matched microwave and millimeter wave termination suitable for use in any microwave system. The present invention also provides a K-band power amplifier combiner that utilizes broad band high power terminations. In the preferred embodiments of the present invention, a resistive, low frequency termination is combined with a broad-band high frequency absorptive element that uses an absorptive material.

The present invention also provides, among other things, a termination for terminating broadband high-power microwave signals. In the preferred embodiment, the termination comprises a microstrip line for transporting the microwave signals, an absorptive element disposed over the microstrip line for absorbing higher frequency portions of the microwave signals, a resistive termination coupling the microstrip line for terminating lower frequency portions of the microwave signals, and a matching network inbetween the resistive termination and the absorptive element for matching the microwave signals to the resistive termination.

The present invention also provides a method of combining amplified microwave signals. In the preferred embodiment, the method comprises the steps of combining amplified microwave signals in a plurality of branch line combiners to provide an output signal, each branch line combiner having input ports, an output port and an isolated port and terminating microwave signals present at each of the isolated ports with a broadband high-power termination.

The present invention also provides a K-band power amplifier combiner. In the preferred embodiments, the K-band power amplifier combiner comprises a plurality of amplifiers, a plurality of branch line combiners for combining output signals from the amplifiers and providing an output signal. Each branch line combiner has input ports, an output port and an isolated port. Each input port is coupled to an output of one of the amplifiers. A termination is provide for each branch line coupler for terminating broad band high power microwave signals present at the isolated port. The termination described above is suitable for use in the K-band power amplifier combiner of the present invention.

The present invention combines a high frequency absorptive element with a low frequency resistive load and a matching network to form an ultra broad band high power load and termination. The present invention also provides a planer high power termination that in general does not need tuning or alignment.

In the preferred embodiment the absorptive material is CR-S-124, commonly known as Eccosorb, manufactured by Emerson & Cuming. Desirably a molded Eccosorb plug is inserted on top of a microstrip transmission line. The Eccosorb absorbs energy at microwave frequencies by providing a very high loss tangent. The microstrip line is terminated with a resistor for low frequency performance. Mid-band frequencies are matched, preferably with a resistor, using a matching circuit inbetween the resistor termination and the Eccosorb plug. As a result, an ultra-broad band response is realized. This broad-band termination of the present invention is adjustable to almost any characteristic impedance by choosing the correct low frequency resistor value and mid-band matching circuit.

FIG. 1 illustrates a broad-band, high power termination in accordance with a preferred embodiment of the present invention. Termination 10 is comprised of a microstrip line 12 having an input 11. The microstrip line is preferably disposed on a Duroid or alumina substrate and preferably has a characteristic impedance of 50 Ohms. Termination 10 includes an absorptive element 13 disposed over the microstrip line on the substrate as shown. Termination 10 includes a mid-band matching network 14 and a resistive termination 15. The mid-band matching network 14 may either be an open ended stub or may be capacitively coupled to ground. The absorptive element 13 is preferably CR-S-124 (Eccosorb) however any carbon based absorptive material is suitable. Resistive termination 15 may be any lumped element resistor or resistive termination and preferably is a standard chip resistor. Preferably, resistive termination 15 is matched to provide good return loss at low frequencies.

Absorptive element 13 is preferably a molded Eccosorb plug having the dimensions on the order of 100 mils by 200 mils in length and 50 by 20 mils in width while being between 50 and 100 mils thick. These dimensions are not meant to be limiting in any way, and are not critical to the performance of the termination. In the preferred embodiment, resistive termination 15 is a ¼ watt 50×50 mil chip resistor. One, two or more of these chip resistors can be combined to form resistive termination 15. Typically this type of chip resistor provides better than 20 dB of return loss for frequencies of 8 Giga-Hertz (GHz) and below. Mid-band matching network 14 improves the attenuation of resistive termination 15 by providing at least 15 dB of return loss for frequencies between 8 and 15 GHz. Absorptive element 13 provides good return loss for frequencies above 15 GHz. Absorptive element 13 desirably handles power levels of at least 1 and 2 watts.

Absorptive element 13 as used in the preferred embodiment of the present invention is preferably approximately 0.14 inches (e.g., about 0.4 wavelengths) in length. This provides more than 13 dB of return loss at 20 GHz. The return loss absorptive element 13 provides is increased by enlarging the Eccosorb block. The high frequency attenuation absorptive element 13 provides is approximately proportional to the length of the microstrip line under the absorptive element 13. At lower frequencies (e.g.,10 GHz and below) at least two factors may cause absorptive element 13 to become less effective as an RF absorber. For example, longer wavelengths result in less attenuation since the lossy absorptive element becomes electrically very short compared to the wavelength. Second, because absorptive element 13 takes advantage of high frequency dispersion effects for greater attenuation, absorptive element 13 does not attenuate as well because at low frequencies, dispersion effects are negligible.

In general, absorptive element 13 contributes less than 3 dB to the overall return loss at lower frequencies (e.g., below 10 GHz). The remaining return loss at these lower frequencies is generally attributed to resistive termination 15 and associated mid-band matching network 14.

Termination 10 has many potential applications, including use in K-band power amplifier combiners as described below. Other potential uses for termination 10 include high power and broad band microwave circuits, for example where the minimization of size and reduction in cost are important. The present invention provides a much wider bandwidth high power termination that is very insensitive to process variation. Both of these aspects reduce alignment time and the associated costs in a high volume production environment.

Figure 2:
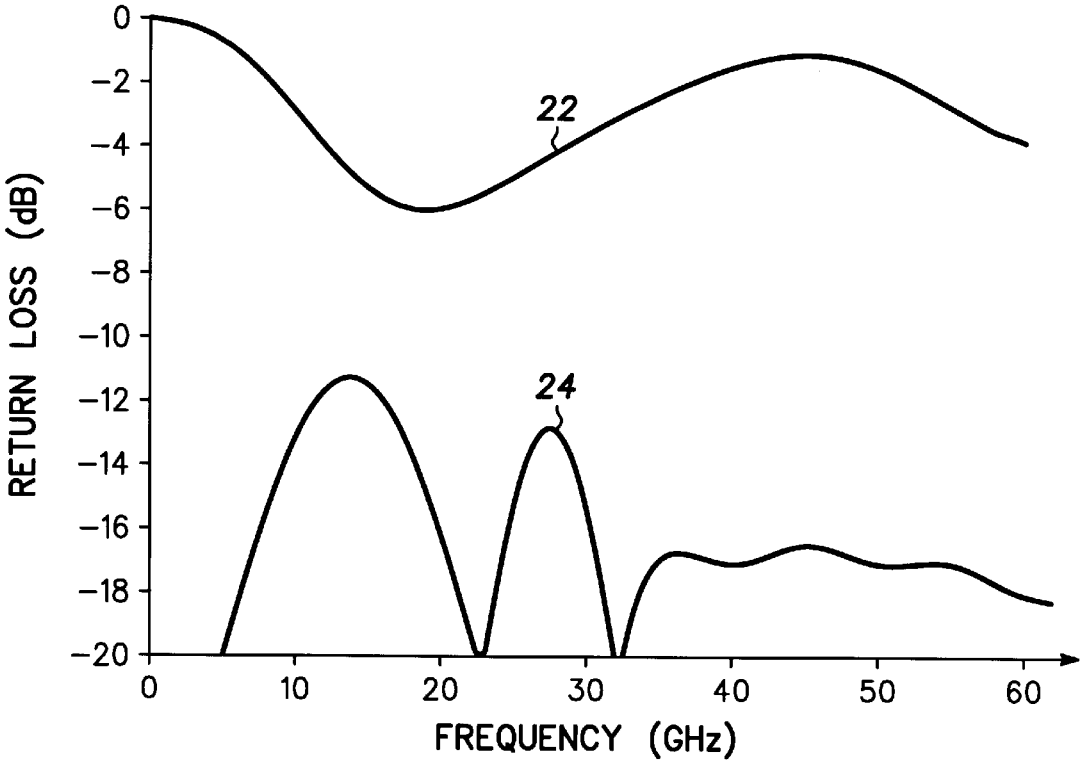
FIG. 2 is a graph illustrating a comparison of a matched resistor termination and a broad-band high power termination in accordance with a preferred embodiment of the present invention.

FIG. 2 is a graph illustrating a comparison of a matched resistor termination and the broad-band high power termination in accordance with a preferred embodiment of the present invention. Graph 22 shows a conventional matched resistor termination while graph 24 shows the return loss of the broad band termination of FIG. 1. Note that the matched resistor termination (i.e., graph 22) provides good return loss over a narrow bandwidth, while the broad band termination (graph 24) provides better return loss over a much broader band.

Figure 3:
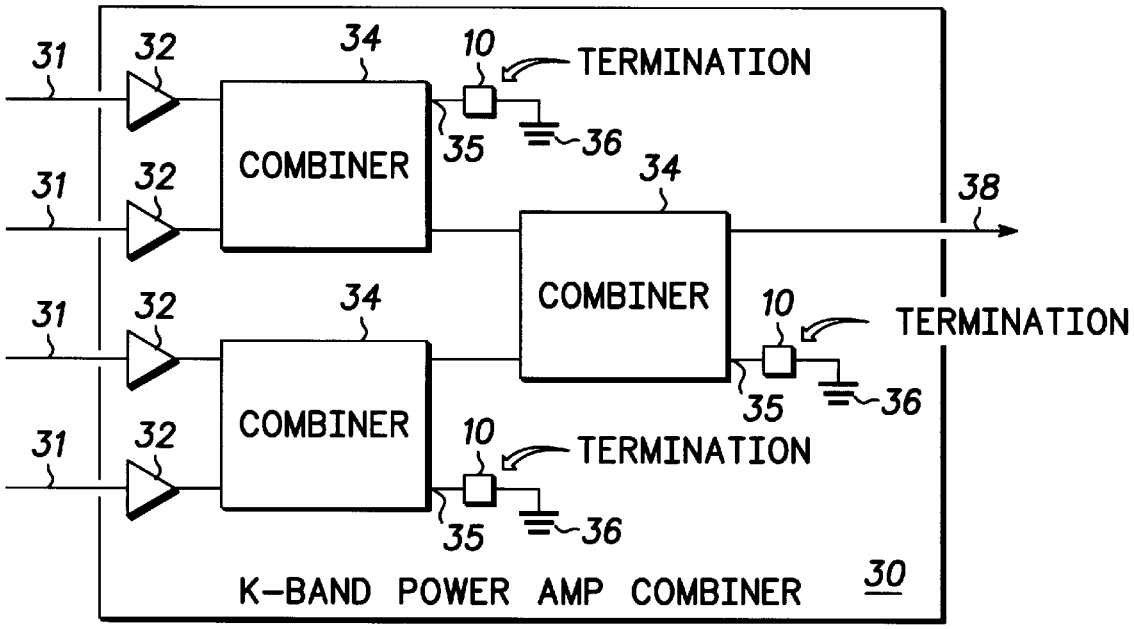
FIG. 3 illustrates a K-band power amplifier combiner that utilizes broad-band, high power terminations in accordance with a preferred embodiment of the present invention.

FIG. 3 illustrates a K-band power amplifier combiner that utilizes broad band, high power terminations in accordance with a preferred embodiment of the present invention. K-band power amplifier combiner 30 has a plurality of input ports 31 for receiving K-band microwave signals, preferably in phase, and provides an output signal at output port 38. In the preferred embodiment, the power level the output signals are between 4.2 and 5 watts.

In the preferred embodiment, amplifier combiner 30 operates typically over the frequency range of 23±1 GHz, however amplifier combiner 30 may be designed to operate over other frequency ranges including K-band or L-band frequencies. K-band power amplifier combiner 30 includes a plurality of amplifiers 32 that feed a plurality of combiners 34. Each combiner has a broad band high power termination 10 coupled to its isolated port 35 to terminate reflected power and out-of-band RF energy. In the preferred embodiment amplifiers 32 are monolithic microwave integrated circuit (MMIC) amplifiers and are matched amplifiers preferably matched and made from the same dye. In the preferred embodiment, combiners 34 are preferably branch line type combiners and terminations 10 are preferably the broad band high power termination 10 shown FIG. 1. Amplifier combiner 30 is preferably fabricated on a single Duroid or alumina substrate.

As part of the branch line coupler design, the isolated ports should be terminated with a matched load. Traditionally, this is done with lumped element resistors matched to the 50 Ohm microstrip transmission line. Typically this will tend to be a very narrow band and may result in out of band low frequency oscillation problems for amplifiers that feed these couplers. Furthermore, lumped element resistors have typically very low power handling capability and make the hardware more vulnerable to poor VSWR loads.

Termination 10 of the present invention, helps prevent these problems. The Eccosorb absorptive element 13 is very broad band as well as being capable of withstanding very high power levels. In order for the K-band power amplifier combiner 30 to handle these high power levels and to terminate low UHF and midrange L-band frequencies, a termination similar to the termination 10 of FIG. 1 is preferably used.

In summary, the present invention provides, among other things, a termination for terminating broadband high-power microwave signals. In the preferred embodiment, the termination comprises a microstrip line for transporting the microwave signals, an absorptive element disposed over the microstrip line for absorbing higher frequency portions of the microwave signals, a resistive termination coupling the microstrip line for terminating lower frequency portions of the microwave signals, and a matching network inbetween the resistive termination and the absorptive element for matching the microwave signals to the resistive termination.

In one embodiment, the resistive termination is a lumped element resistor and the absorptive element is a molded plug of an absorptive material. In another embodiment, the absorptive material is made from Eccosorb. In another embodiment, the matching network is an open ended microstrip line. Preferably, the microstrip line has first and second ends, the first end is an input for receiving microwave signals at power levels of up to four watts, the second end coupled to the resistive termination. In another embodiment, the absorptive element provides attenuation of signals present at the first end above 20 GHz. Preferably, the absorptive element provides a return loss greater at the first end of greater than 13 dB for frequencies above 20 GHz, and the higher frequency portions are substantially above ten GHz, and the lower frequency portions are substantially below ten GHz. Desirably, the absorptive element has a length dimension disposed over the microstrip line that is proportional to the wavelength of the higher frequency portions.

Preferably, the microstrip line is disposed on a substrate that is substantially planar and made from alumina. The absorptive element has a length dimension of between 100 and 200 mils, a width dimension of between 50 and 200 mils and a height dimension of at least 50 mils. The width dimension is perpendicular to the microstrip line, the length dimension is parallel to the microstrip line, and the height dimension is perpendicular to the substrate.

In summary the present invention also provides a method of combining amplified microwave signals. In the preferred embodiment, the method comprises the steps of combining amplified microwave signals in a plurality of branch line combiners to provide an output signal, each branch line combiner having input ports, an output port and an isolated port and terminating microwave signals present at each of the isolated ports with a broadband high-power termination. The terminating step comprises the steps of transporting the microwave signals present at the isolated port on a microstrip line, absorbing higher frequency portions of the microwave signals present at the isolated port with an absorptive element disposed over the microstrip line, terminating lower frequency portions of the microwave signals present at the isolated port with a resistive termination, and matching the microwave signals present at the isolated port to the resistive termination with a matching network located inbetween the resistive termination and the absorptive element.

In summary, the present invention also provides a K-band power amplifier combiner. In the preferred embodiments, the K-band power amplifier combiner comprises a plurality of amplifiers, plurality of branch line combiners for combining output signals from the amplifiers and providing an output signal. Each branch line combiner has input ports, an output port and an isolated port. Each input port is coupled to an output of one of the amplifiers. A termination is provide for each branch line coupler for terminating broad band high power microwave signals present at the isolated port. The termination described above is suitable for use in the K-band power amplifier combiner of the present invention.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A termination for terminating broadband high-power microwave signals comprising:

a microstrip line for transporting said microwave signals;

an absorptive element disposed over said microstrip line for absorbing higher frequency portions of said microwave signals;

a resistive termination coupling to said microstrip line for terminating lower frequency portions of said microwave signals; and a matching network inbetween said resistive termination and said absorptive element for matching said microwave signals to said resistive termination.

2. A termination as claimed in claim 1 wherein said resistive termination is a lumped element resistor and wherein said absorptive element is a molded plug of a carbon based absorptive material.

3. A termination for terminating broadband high-power microwave signals comprising:

a microstrip line for transporting said microwave signals;

an absorptive element disposed over said microstrip line for absorbing higher frequency portions of said microwave signals, said absorptive element being a molded plug of an absorptive material, said absorptive material being a carbon based material;

a resistive termination coupling to said microstrip line for terminating lower frequency portions of said microwave signals, said resistive termination being a lumped element resistor; and a matching network inbetween said resistive termination and said absorptive element for matching said microwave signals to said resistive termination, said matching network being an open ended microstrip line.

4. A termination as claimed in claim 3 wherein said microstrip line for transporting said microwave signals has first and second ends, said first end being an input for receiving microwave signals at power levels of up to four watts, said second end coupled to said resistive termination.

5. A termination as claimed in claim 4 wherein said absorptive element provides attenuation of signals present at said first end above 20 GHz.

6. A termination as claimed in claim 5 wherein said termination, at said first end of said microstrip line provides a return loss greater than 13 dB for frequencies above 20 GHz.

7. A termination as claimed in claim 6 wherein said higher frequency portions are substantially above ten GHz, and said lower frequency portions are substantially below ten GHz.

8. A termination as claimed in claim 7 wherein said absorptive element has a length dimension disposed over said microstrip line, said length dimension being proportional to the wavelength of said higher frequency portions.

9. A termination as claimed in claim 8 wherein said microstrip line is disposed on a substrate that is substantially planar and made from alumina, and wherein said absorptive element has a length dimension of between 100 and 200 mils, a width dimension of between 50 and 200 mils and a height dimension of at least 50 mils, the width dimension being perpendicular to said microstrip line, said length dimension being parallel to said microstrip line, and said height dimension being perpendicular to said substrate.

10. A K-band power amplifier combiner comprising:

a plurality of amplifiers;

a plurality of branch line combiners for combining output signals from said amplifiers and providing an output signal, each branch line combiner having input ports, an output port and an isolated port, each input port coupled to an output of one of said amplifiers; and a termination for each branch line coupler for terminating broad band high power microwave signals present at said isolated port, said termination comprising:

a microstrip line;

an absorptive element disposed over said microstrip line for absorbing higher frequency portions of said microwave signals substantially above ten GHz;

a resistive termination coupling to said microstrip line for terminating lower frequency portions of said microwave signals substantially below ten GHz; and a matching network inbetween said resistive termination and said absorptive element for matching said microwave signals to said resistive termination.

11. A K-band power amplifier combiner as claimed in claim 10 wherein said resistive termination is a lumped element resistor and wherein said absorptive element is a molded plug of a carbon based absorptive material.

12. A K-band power amplifier combiner comprising:

a plurality of amplifiers;

a plurality of branch line combiners for combining output signals from said amplifiers and providing an output signal, each branch line combiner having input ports, an output port and an isolated port, each input port coupled to an output of one of said amplifiers; and a termination for each branch line coupler for terminating broad band high power microwave signals present at said isolated port, said termination comprising:

a microstrip line for transporting said high power microwave signals;

an absorptive element disposed over said microstrip line for absorbing higher frequency portions of said microwave signals substantially above ten GHz, said absorptive element being a molded plug of made from a carbon based absorptive material;

a resistive termination coupling to said microstrip line for terminating lower frequency portions of said microwave signals substantially below ten GHz, said resistive termination being a lumped element resistor; and a matching network inbetween said resistive termination and said absorptive element for matching said microwave signals to said resistive termination, said matching network being an open ended microstrip line.

13. A K-band power amplifier combiner as claimed in claim 12 wherein said microstrip line for transporting said high power microwave signals has first and second ends, said first end being an input for receiving microwave signals at power levels of up to four watts, said second end coupled to said resistive termination.

14. A K-band power amplifier combiner as claimed in claim 13 wherein said absorptive element provides attenuation of signals present at said first end above 20 GHz.

15. A K-band power amplifier combiner as claimed in claim 14 wherein said termination, at said first end of said microstrip line, provides a return loss greater than 13 dB for frequencies above 20 GHz.

16. A K-band power amplifier combiner as claimed in claim 15 wherein said higher frequency portions are substantially above ten GHz, and said lower frequency portions are substantially below ten GHz.

17. A K-band power amplifier combiner as claimed in claim 16 wherein said absorptive element has a length dimension disposed over said microstrip line, said length dimension being proportional to the wavelength of said higher frequency portions.

18. A K-band power amplifier combiner as claimed in claim 17 wherein said microstrip line is disposed on a substrate that is substantially planar and made from alumina, and wherein said absorptive element has a length dimension of between 100 and 200 mils, a width dimension of between 50 and 200 mils and a height dimension of at least 50 mils, the width dimension being perpendicular to said microstrip line, said length dimension being parallel to said microstrip line, and said height dimension being perpendicular to said substrate.

19. A method of combining amplified microwave signals comprising the steps of:

combining amplified microwave signals in a plurality of branch line combiners to provide an output signal, each branch line combiner having input ports, an output port and an isolated port; and terminating microwave signals present at each of said isolated ports with a broadband high-power termination, said terminating step comprising the steps of:

transporting said microwave signals present at said isolated port on a microstrip line;

absorbing higher frequency portions of said microwave signals present at said isolated port with an absorptive element disposed over said microstrip line;

terminating lower frequency portions of said microwave signals present at said isolated port with a resistive termination; and matching said microwave signals present at said isolated port to said resistive termination with a matching network located inbetween said resistive termination and said absorptive element.

20. A method as claimed in claim 19 wherein said higher frequency portions are substantially above ten GHz, and said lower frequency portions are substantially below ten GHz.

21. A method as claimed in claim 20 wherein in the terminating step, said resistive termination is a lumped element resistor and wherein said absorptive element is a molded plug of a carbon based absorptive material.

22. A method of combining amplified microwave signals comprising the steps of:

combining amplified microwave signals in a plurality of branch line combiners to provide an output signal, each branch line combiner having input ports, an output port and an isolated port; and terminating microwave signals present at each of said isolated ports with a broadband high-power termination, said terminating step comprising the steps of:

transporting said microwave signals present at said isolated port on a microstrip line;

absorbing higher frequency portions of said microwave signals present at said isolated port with an absorptive element disposed over said microstrip line, said higher frequency portions being substantially above ten GHz, said absorptive element being a molded plug of a carbon based absorptive material;

terminating lower frequency portions of said microwave signals present at said isolated port with a resistive termination, said lower frequency portions being substantially below ten GHz, said resistive termination being a lumped element resistor; and matching said microwave signals present at said isolated port to said resistive termination with a matching network located inbetween said resistive termination and said absorptive element, said matching network being an open ended microstrip line.

23. A method as claimed in claim 22 wherein in the terminating step, said microstrip line for transporting said microwave signals has first and second ends, said first end being an input for receiving microwave signals at power levels of up to four watts, said second end coupled to said resistive termination.

24. A method as claimed in claim 23 wherein in the terminating step, said termination, at said first end of said microstrip line, provides a return loss greater than 13 dB for frequencies above 20 GHz.

25. A method as claimed in claim 24 wherein in the terminating step, said higher frequency portions are substantially above ten GHz, and said lower frequency portions are substantially below ten GHz.

26. A method as claimed in claim 25 wherein in the terminating step, said absorptive element has a length dimension disposed over said microstrip line for transporting said microwave signals, said length dimension being proportional to the wavelength of said higher frequency portions.

27. A method as claimed in claim 26 wherein in the terminating step, said microstrip line is disposed on a substrate that is substantially planar and made from alumina, and wherein said absorptive element has a length dimension of between 100 and 200 mils, a width dimension of between 50 and 200 mils and a height dimension of at least 50 mils, the width dimension being perpendicular to said microstrip line, said length dimension being parallel to said microstrip line, and said height dimension being perpendicular to said substrate.

* * * * *